US005870902A

United States Patent [19]

Garrett, Jr.

[11] Patent Number: 5,870,902

[45] Date of Patent: Feb. 16, 1999

[54] RAIN SHIELD FOR OUTDOOR APPLIANCES

[75] Inventor: Jack B. Garrett, Jr., Nashville, Tenn.

[73] Assignee: International Comfort Products Corporation (USA), Nashville, Tenn.

[21] Appl. No.: 757,436

[22] Filed: Nov. 27, 1996

[51] Int. Cl.[6] ..... F25D 23/12; E06B 7/16

[52] U.S. Cl. ..... 62/259.1; 49/484.1

[58] Field of Search ..... 62/298, 303, 259.1; 49/484.1, 475.1, 483.1, 495.1

[56] References Cited

U.S. PATENT DOCUMENTS

| | | | |
|---|---|---|---|
| 2,190,954 | 2/1940 | Stickel | 49/484.1 |
| 2,265,272 | 12/1941 | Ditzler | 62/140 |
| 2,349,668 | 5/1944 | Marker et al. | 98/43 |
| 3,089,315 | 5/1963 | Brandt | 62/326 |
| 3,341,975 | 9/1967 | Tylisz | 49/484.1 |
| 3,358,402 | 12/1967 | Sahm | 49/484.1 |
| 3,678,993 | 7/1972 | Pierce | 165/76 |
| 3,742,725 | 7/1973 | Berger | 62/419 |
| 3,831,321 | 8/1974 | Johnson | 49/465 |
| 4,449,376 | 5/1984 | Draper et al. | 62/259.1 |
| 4,554,796 | 11/1985 | Stankard | 62/326 |
| 4,665,654 | 5/1987 | Stedron | 49/484.1 |
| 4,698,982 | 10/1987 | Laios et al. | 62/286 |
| 4,805,418 | 2/1989 | Ishizuka et al. | 62/298 |
| 5,186,528 | 2/1993 | Schardt et al. | 312/100 |
| 5,444,990 | 8/1995 | McGill, III et al. | 62/298 |
| 5,711,706 | 1/1998 | Griffin et al. | 454/338 |

*Primary Examiner*—William Doerrler
*Attorney, Agent, or Firm*—Baker & Daniels

[57] ABSTRACT

The present invention involves a rain shield assembly for a package air conditioner and heat pump unit. A cover is pivotally mounted to the package unit housing and has a sealing pad made of a resilient foam material. When the cover is moved to a sealing position, the foam pad contacts foam sealing strips that are attached to the unit housing and that separately ring access openings provided in the housing. Electrical circuitry such as circuit breakers may port through these access openings. Cavities are provided in the sealing pad in alignment with the access openings to accommodate projecting handles or switches of the electrical circuitry. The contact between the sealing pad and the sealing strips forms water-tight seals around the portion of the electrical circuitry projecting from the package unit housing so as to protect the circuitry from potentially damaging exposure to the elements.

18 Claims, 3 Drawing Sheets

RAIN SHIELD FOR OUTDOOR APPLIANCES

BACKGROUND OF THE INVENTION

The present invention pertains to electrically powered appliances installed outdoors, and, in particular, to an apparatus for shielding from the elements the electrical circuitry of an appliance such as a package air conditioner and heat pump unit.

Package air conditioner and heat pump units are conventionally employed with mobile homes and modular homes, but may also find useful application in residential and commercial buildings. Package units of this general type are installed outdoors and connected via return and supply ducts to the air ducts within, for example, a mobile home. When operated, the package unit furnishes the heating and cooling airflow required to maintain a comfortable living environment within the mobile home.

One problem with existing package units pertains to the need to protect their electrical circuitry from exposure to weather conditions, such as rain, which could compromise the operation of the circuitry. Depending on their intended uses, package units may be equipped with disconnect switches to satisfy safety codes and/or circuit breakers to control, for example, electric strip heating elements incorporated into the package units to achieve additional heating capabilities. While positioning disconnect switches and circuit breakers completely inside the package unit housing may aid in preventing moisture from reaching such electrical componentry, the need to disassemble the housing to service or operate such componentry may be both time-consuming and inconvenient.

One prior art design to increase accessibility to disconnect switches and circuit breakers involved porting such circuitry through openings in the package unit housing and covering such circuity with a rain shield that could be pivoted to a retracted position for circuitry access. In this design, the electrical circuitry was disposed on the positive pressure side of the package unit, and consequently air which passed between the rain shield and the unit housing during package unit operation was blown out from the package unit. However, because the package unit blower does not operate at all times and a positive pressure condition is therefore not continually present, moisture can still seep between the rain shield and the unit housing to reach the circuitry underneath the rain shield. Furthermore, such a rain shield is of limited effectiveness in situations where circuitry is to be mounted on the negative pressure side of the package unit, as air potentially laden with moisture tends to be drawn or pulled toward the electrical circuitry in such situations.

Thus, it would be desirable to provide an apparatus which allows electrical circuitry to be accessibly mounted on the exterior of a package unit while still protecting such circuitry from the elements.

SUMMARY OF THE INVENTION

The present invention provides a hingedly mounted, closable rain shield assembly which seals against the housing of an appliance such as a package unit to achieve a moisture barrier between the rain shield assembly and the appliance housing. The sealing achieved by the assembly allows electrical componentry of the appliance to extend through openings in the appliance housing and to be sealed off and thereby protected from rain and high humidity in the air which could impair the componentry operation.

In one form thereof, the present invention involves a package air conditioner with a housing with an access opening, a unit for conditioning air, and a switch associated with the unit and located in the access opening. The package air conditioner further includes a cover movably mounted to the housing and moveable between a first position and a second position. The access opening of the housing is uncovered by the cover when the cover is arranged in the first position. Additionally, a first seal member is attached to either the housing or the cover. This first seal member is structured and arranged to be sealingly disposed between the cover and the housing when the cover is arranged in the second position to form a moisture barrier around the access opening in the housing.

In another form thereof, the present invention involves a package air conditioner with a housing with an access opening, a unit for conditioning air, a switch associated with the unit and located in the access opening, means for movably mounting the cover to the housing to be movable between an unsealed position and a sealing position, and sealing means for providing a fluid-tight seal between the cover and the housing when the cover is disposed in the sealing position to prevent moisture external to the cover from reaching the access opening.

In still another form thereof, the present invention provides involves a package air conditioner with a housing with an access opening, a unit for conditioning air, and a switch associated with the unit and located in the access opening. The package air conditioner includes a bracket installed on the housing, a cover pivotally connected to the bracket and moveable between first and second positions, wherein the cover uncovers the access opening when disposed in the first position, and a first sealing member associated with the cover. The first sealing member forms a circumferential, water-tight seal around the access opening and between the cover and the housing when the cover is disposed in the second position.

One advantage of the present invention is that circuit breakers and disconnect switches mounted to be accessible without disassembly of the package unit housing may be sealingly protected from the elements.

Another advantage of the present invention is that a reliable, water-tight seal may be furnished on a rain shield in a cost effective manner.

Still another advantage of the present invention is that a rain shield is provided which when latched closed to prevent inadvertent opening ensures a proper seal with the appliance housing.

Still another advantage of the present invention is that access openings provided on a package unit housing which are unused in a particular application may be blocked in a simple and user-friendly manner.

BRIEF DESCRIPTION OF THE DRAWINGS

The above mentioned and other advantages and objects of this invention, and the manner of attaining them, will become more apparent and the invention itself will be better understood by reference to the following description of an embodiment of the invention taken in conjunction with the accompanying drawings, wherein.

Figure 1:
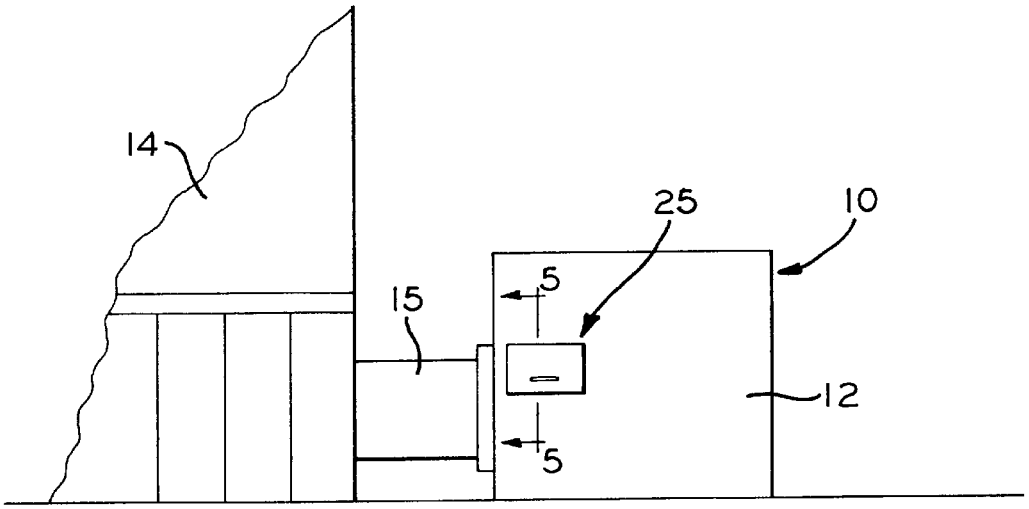
FIG. 1 is a diagrammatic front view of a rain shield assembly of the present invention attached to a package unit in air flow communication with a partially shown mobile home.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENT

The preferred embodiment disclosed below is not intended to be exhaustive or limit the invention to the precise form disclosed in the following detailed description. Rather, the embodiment is chosen and described so that others skilled in the art may utilize its teachings.

Referring now to FIG. 1, a first embodiment of a rain shield assembly of the present invention is generally designated 25 and is installed on a housing side panel 12 of a package air conditioner and heat pump unit, generally designated 10. For purposes of this application, the term "package air conditioners" or "unit for conditioning air" is meant to encompass any unit for heating and/or cooling and/or otherwise treating air, e.g., heat pumps, cooling air conditioners, gas, oil, or electric furnaces, humidifiers, purifiers, etc. Package unit 10 is connected to the duct work of a structure, such as a mobile home indicated at 14, via air return duct 15 and an air supply duct obscured in FIG. 1 by return duct 15. Package units of this general type are well known, and include the package unit described in U.S. Pat. No. 5,444,990 to McGill, III et al., the teachings of which are expressly incorporated herein by reference.

Figure 2:
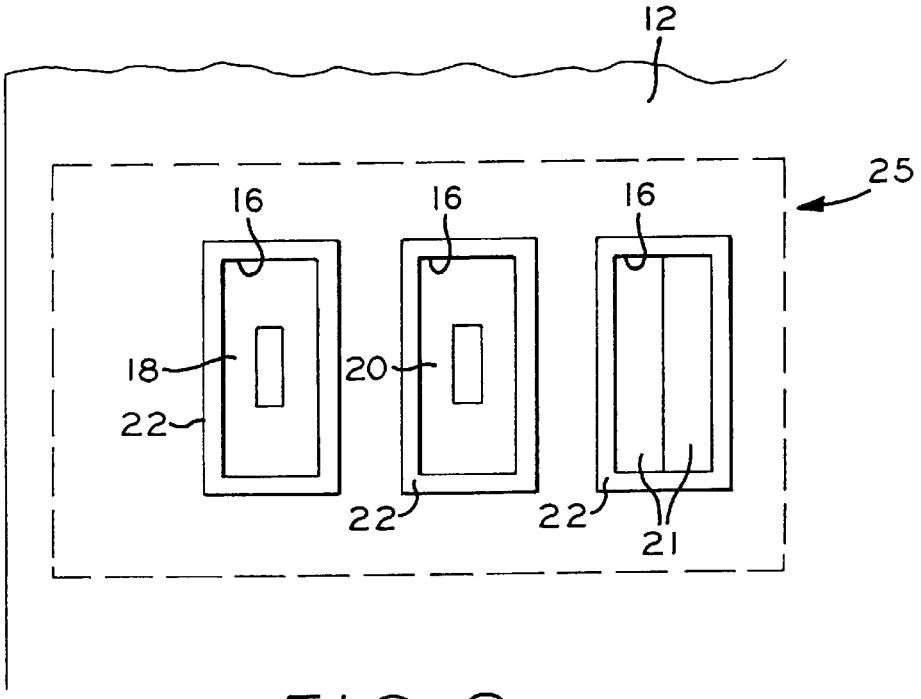
FIG. 2 is a front view of a portion of the package unit of FIG. 1, wherein the outline of the rain shield assembly when in its protective position sealingly covering access openings located in the package unit housing is shown in dashed lines.

With additional reference to FIG. 2, housing side panel 12 is provided with a row of three, equally spaced apart access holes or openings 16 that open into the interior of package unit 10. Due to the sealing function achieved by rain shield assembly 25 as further described below, access openings 16 may be manufactured into either the positive or negative pressure sides of the package unit housing. Each access opening 16 is rectangular in shape and sized and arranged identical to the other openings 16. Access openings 16 allow electrical circuitry relating to the control of package unit 10 to be accessible on the unit housing exterior. For example, and as shown in FIG. 2, an abstractly shown circuit breaker 18, which may be circuited to an electric strip heating element mounted within package unit 10, and an abstractly shown disconnect switch 20 may fill and port or project through separate access openings 16. Filler plates 21 described further below are shown installed to close off the one access opening 16 not required for the illustrated package unit configuration to prevent either inadvertent insertion of one's fingers or introduction of moisture into the package unit interior when rain shield assembly 25 is opened. While shown and described herein with reference to three identical openings 16, depending on the intended use, package unit 10 may be provided with fewer or additional openings, as well as with different sized or shaped openings, within the scope of the invention.

Secured to the exterior surface of housing panel 12 are three panel seals 22. In the shown embodiment, each seal 22 is rectangular in shape and includes an internal rectangular opening coextensive with access opening 16. Seals 22 are shaped to fit circumferentially around the housing access openings 16 and are sized to provide a five millimeter wide, planar sealing face parallel to the housing surface. A suitable material for seals 22 is a closed cell polyethylene foam, having a minimum density of about 1.5 pounds per cubic foot, and a suitable foam thickness or depth for seals 22 is about 3.2 millimeters. Other sealing materials, including elastomeric and resilient gaskets, may be substituted within the scope of the invention for the foam construction of seals 22. Still further, other seal shapes, including a single panel seal which encircles all of the openings together may be employed. A pressure sensitive adhesive covered by an easy release liner on the back face of each seal 22 allows for the ready and secure installation of seals 22 to housing panel 12.

Figure 3:
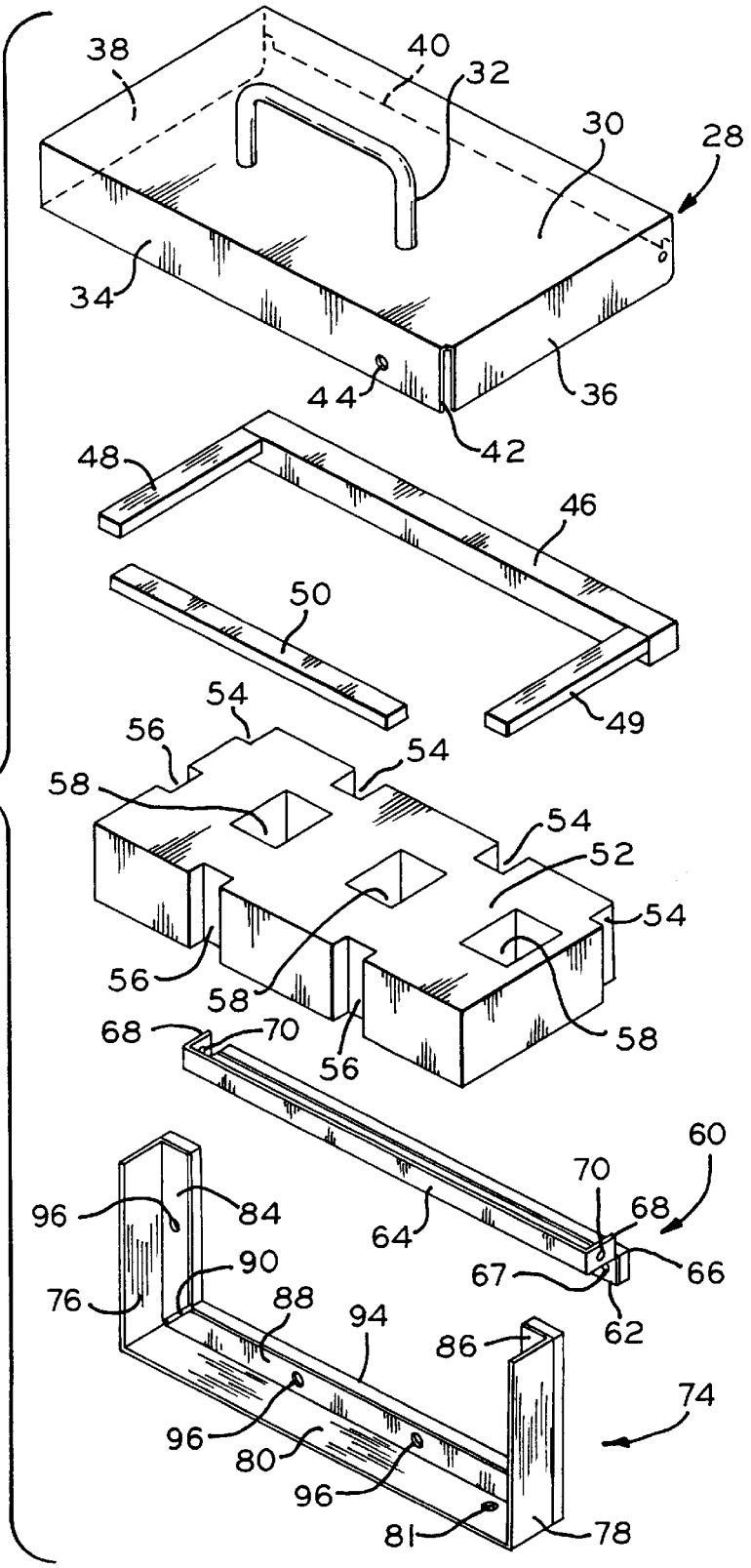
FIG. 3 is an exploded view of components of the rain shield assembly of FIG. 1 after being arranged in an open position to allow ready access to electrical componentry of the package unit.
Figure 4:
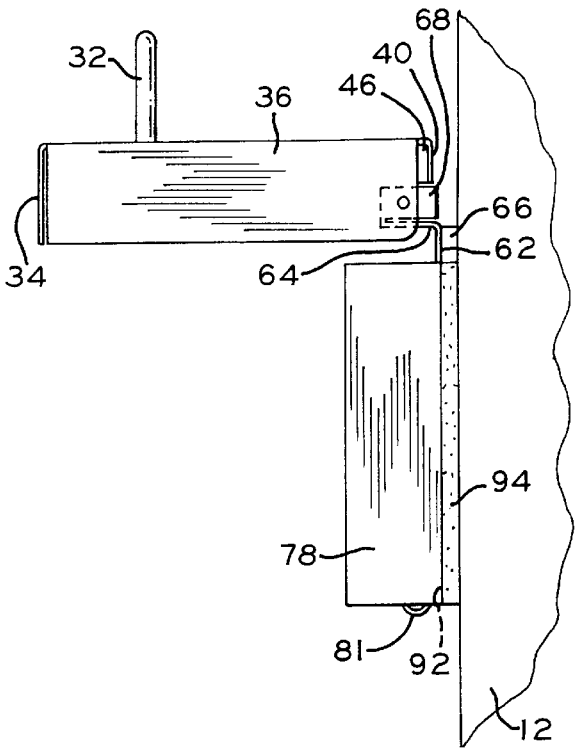
FIG. 4 is a side view of the rain shield assembly of FIG. 1 mounted on the package unit housing in the open position.
Figure 5:
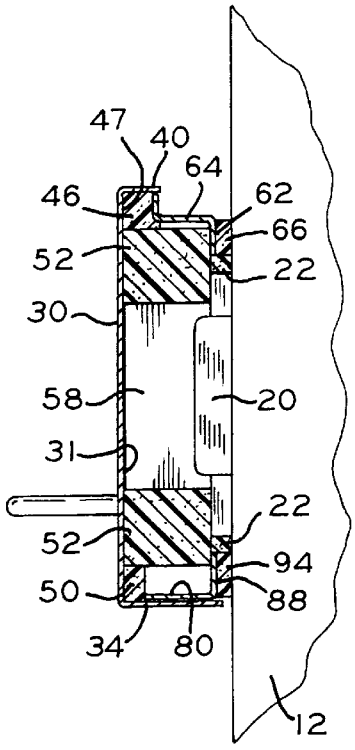
FIG. 5 is a cross-sectional side view, taken along line 5—5 of FIG. 1, of the rain shield assembly arranged in a sealing position.

The overall structure of rain shield assembly 25 will be further understood with additional reference to FIGS. 3–5. With primary reference to FIG. 3, which is an exploded view of components of rain shield assembly 25 as arranged when assembly 25 is opened to allow circuit breaker 18 and disconnect switch 20 to be operated, cover 28 is constructed from a suitably rigid material, such as a 16 gauge, G-90 galvanized steel painted to match the housing of package unit 10. Cover 28 includes a plate-shaped body 30 to which is secured a handle 32 with fasteners such as machine screws (not shown). Bent back at ninety degree angles from cover body 30 are a base or bottom flange 34, a right side flange 36, a left side flange 38, and an upper or top flange 40. A slot-shaped gap 42 provided at the bottom corner of cover 28 between base flange 34 and right side flange 36, and a similar slot-shaped gap (not shown) between left side flange 38 and base flange 34, allows fluid to drain from underneath cover 28. A circular aperture or recess 44 in base flange 34 provides for rain shield assembly latching as described below.

Adhesively and sealingly secured to the rearward surface 31 of body 30 are cover strip seal 46 and locator strip seals 48, 49, and 50. All of strip seals 46 and 48–50 are formed of a suitable sealing material, such as the same material from which panel seals 22 are formed. The upper face 47 of strip seal 46 abuts cover top flange 40, and strip seal 46 extends the entire width between right side flange 36 and left side flange 38. Locator strip seal 48 abuts both strip seal 46 and left side flange 38. Locator strip seal 49 abuts both strip seal 46 and right side flange 36. Locator strip seal 50 is centered along the width of cover body 30 and abuts base flange 34. In addition to an ancillary sealing function, locator strip seals 48–50, locate the installation of sealing pad 52.

Sealing pad 52, which is constructed from the same sealing material as panel seals 22, is formed with a general overall shape of a parallelepiped. Sealing pad 52 is adhesively secured to body rearward surface 31 and is sized such that its periphery contacts cover strip seal 46 and locator strip seals 48–50. Notches 54 in the top edge of sealing pad 52, and notches 56 in the side and bottom edges of sealing pad 52, are sized and shaped such that when sealing cover 28 and sealing pad 52 are arranged in a sealing position shown in FIG. 5, notches 54 and notches 56 accommodate the heads of fasteners used to install bracket 60 and base frame 74, respectively, to housing panel 12. In the exemplary embodiment, the right sided of pad 52 is sufficiently trimmed to clear fasteners located on the right side. However, it is possible that other configurations of pads would be needed for other circuit breaker openings.

Three rectangular openings 58 extend through the entire thickness of sealing pad 52. Each of the openings 58 is aligned with one of the access openings 16 when assembly 25 is arranged in the sealing position shown in FIG. 5, and openings 58 serve as cavities into which the handles or protruding portions of circuit breaker 18 and disconnect switch 20 may project. In the exemplary embodiment, the openings are centered for the circuit breaker handle and not just the circuit breaker opening itself. Further, the circuit breaker handle is not conventionally centered on the circuit breaker.

Mounting bracket 60 and base frame 74 are each formed in one piece of the same material as cover 28 and painted to match the unit housing. Mounting bracket 60 includes a mounting flange 62 and a sealing flange 64. A foam seal 66 coextensive with mounting flange 62 is adhesively secured to the rear face of mounting flange 62. Fasteners such as machine screws (not shown) insert through a row of apertures 67 through mounting flange 62 and then through foam seal 66 to fixedly mount bracket 60 to housing panel 12. During bracket mounting, foam seal 66 is compressed between bracket 60 and housing panel 12 to provide a water-tight seal along the entire width of bracket 60 that prevents water running down along the surface of housing panel 12 toward assembly 25 from reaching access openings 16. Sealing flange 64 is an L-shaped member which forwardly projects from the upper edge of mounting flange 62. Two tabs 68 bent back from the opposite, lateral edges of sealing flange 64 include apertures 70. Rivets (not shown) extend through apertures in cover side flanges 36, 38 and tab apertures 70 to pivotally mount cover 28 to bracket 60. When cover 28 is installed on bracket 60, and as shown in FIG. 5, sealing flange 64 is pressed into sealing contact with cover strip seal 46, which resiliently conforms to flange 64. During pivoting of cover 28 relative to bracket 60, sealing flange 64 continuously remains in contact with cover strip seal 46 to maintain a water-tight seal therebetween.

Base frame 74 is shaped overall in a wide U-shape and includes side flanges 76, 78 spanned by base flange 80. A downwardly projecting nub 81 along the underside of base flange 80 cooperates with circular aperture or recess 44 in cover base flange 34 to latch rain shield assembly 25 in a sealing position. Side mounting flanges 84, 86 and base mounting flange 88 orthogonally project from flanges 76, 78 and 80. A slot shaped gap 90 between side mounting flange 84 and base mounting flange 88 and which extends into the edge of the intersection of side flange 76 and base flange 88, and a slot shaped gap 92 (See FIG. 4) between side mounting flange 86 and base mounting flange 88 and which extends into the corner of the intersection of side flange 78 and base flange 80, allow drainage of any water which may accumulate on base frame 74 should it be forwardly inclined upon unit installation. A single, U-shaped foam seal 94 is adhesively connected to and covers completely the back surfaces of mounting flanges 84, 86 and 88. Fasteners such as machine screws (not shown) insert through apertures 96 provided in mounting flanges 84, 86 and 88 to fixedly mount base frame 74 to housing panel 12. The sandwiching of foam seal 94 between base frame 74 and housing panel 12 provides a water-tight seal. As shown in FIG. 4, because base frame seal 94 and bracket seal 66 abut each other when rain shield assembly 25 is installed, seals 94 and 66 enclose an area on housing panel 12 from which moisture is sealed off and prevented from reaching by way of passage between panel housing 12 and base frame 74 and bracket 60.

Figure 6:
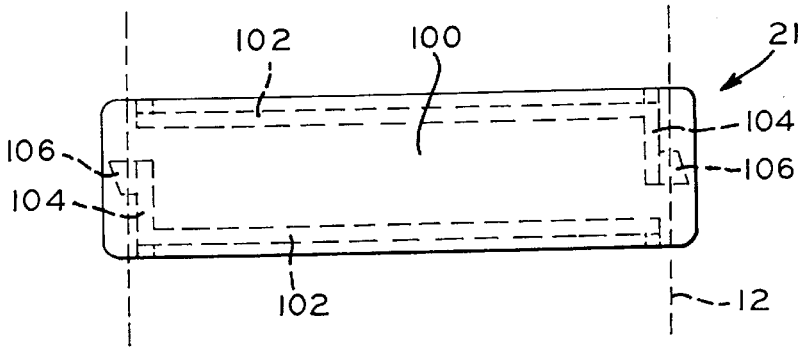
FIG. 6 is a top view of a filler plate used in conjunction with the present invention.

Referring now to FIG. 6, one filler plate 21 is shown in front view. The filler plate shown in the exemplary embodiment is a conventional design, and other filler plate configurations may be used with the present invention. Filler plate 21 is molded from an electrically insulative plastic and includes a plate-shaped body 100 from which downwardly extend two straight ribs 102. Resilient latching fingers 104 spaced from the underside of body 100 perpendicularly project from the ends of ribs 102. At its cantilevered end, each finger 104 includes a projecting locking member or tab 106. The underside of each locking member 106 rearwardly slopes toward its respective finger 104 to provide a cammable surface for plate insertion. During installation of filler plate 21 within an access opening 16, filler plate 21 is pressed down such that the housing 12 engages the inclined undersides of locking members 106 to force fingers 104 to bend and to thereby shift locking members 106 centrally. When filler plate 21 has been sufficiently inserted such that housing panel 12 may fit between the underside of body 100 and the top face of locking members 106, locking members 106 snap back to their normal arrangements shown in FIG. 6 to secure filler plate 21 to the housing panel 12 shown abstractly in dashed lines in FIG. 6. While two filler plates 21 are shown in FIG. 2 to close or cover a single access opening 16, in alternate designs fewer or additional filler plates may be employed within the scope of the invention. The function of the filler plate may be handled by numerous methods, such as using a plastic piece and a metal piece with screws or other fasteners, or adhesive backed foam pads, to secure the filler plate to the housing panel.

The structure of rain shield assembly 25 will be further understood in view of the following explanation of its operation. When rain shield assembly 25 is in its normal, operational position best shown in FIGS. 1 and 5, the planar, rearward surface of sealing pad 52 directly contacts panel seals 22 around the entire panel seal circumference. This direct contact slightly compresses sealing pad 52 and panel seals 22 and achieves a water-tight seal therebetween around the entire circumference of each exposed piece of circuitry, such as the disconnect switch 20 extending from access opening 16. It will be recognized that rather than the planar configuration shown, sealing pad 52 may include, for example, projecting ribs which engage panel seals 22 or which directly engage housing panel 12. Moreover, in alternate embodiments, panel seals 22 may engage cover 28 directly, or multiple seals rather than a common pad may be provided on cover 28.

It will be recognized that when arranged in the sealing position, rain shield assembly 25 prevents moisture from reaching electrical circuitry of package unit 10. Any rain or moisture which lands on the horizontal segment of bracket sealing flange 64 tends to run off laterally and down through the rain shield assembly to drain through the drainage gaps, such as gap 42, provided on cover 28, or to drain from slots 90 and 92 on base frame 74.

Rain shield assembly 25 is latched or secured in the sealing position by the insertion of latching nub 81 into base flange aperture or recess 44 during the closing, or pivoting down, of cover 28. Nub 81 and aperture or recess 44 are positioned such that in order to achieve their engagement, cover 28 must be pivoted a sufficient distance to ensure that a satisfactory sealing engagement between sealing pad 52 and panel seals 22 is achieved.

In order to access the circuit breakers or disc switches of package unit 10, an operator grasps and pulls on handle 32. The force required to be applied is that amount necessary to achieve a flexure of base flange 34 sufficient to move aperture or recess 44 free of nub 81. When cover 28 is pivoted to the perpendicular orientation shown in FIG. 4, an operator may freely access the circuit breakers or disc switches. When an operator completes control of the unit circuitry, rain shield assembly 25 may be returned to its sealing position shown in FIG. 5 to protect the circuitry from the elements.

While this invention has been shown and described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A package air conditioner comprising:

a housing including an access opening;

a unit for conditioning air disposed within said housing;

an electrical switch associated with said unit for conditioning air located in said access opening and extending therefrom;

a cover movably mounted on said housing and moveable between a first position and a second position, said access opening being uncovered by said cover when said cover is moved to said first position;

a seal member attached to one of said housing and said cover;

said seal member including a cavity therein, said cavity aligned with said access opening when said cover is disposed in said second position with said electrical switch extending into said cavity whereby said seal member is sealingly disposed between said cover and said housing when said cover is arranged in said second position to provide a moisture barrier around said access opening.

2. The package air conditioner of claim 1 further comprising a bracket fixedly secured to said housing, wherein said cover is pivotally connected to said bracket, allowing said cover to pivot relative to said bracket during movement from said first position to said second position.

3. The package air conditioner of claim 2 further comprising a sealing strip sandwiched between said bracket and said housing to form a moisture barrier.

4. The package air conditioner of claim 1 wherein said seal member is fixedly secured to said cover.

5. The package air conditioner of claim 1 wherein said housing includes a plurality of access openings, said seal member includes a plurality of cavities aligned with said plurality of access openings when said cover is disposed in said second position.

6. The package air conditioner of claim 1 further comprising a base frame secured to said housing, wherein said base frame comprises a first latching module, and wherein said cover comprises a second latching module complementarily structured with said first latching module to allow latching together of said cover and said base frame when said cover is disposed in said second position, said first and second latching modules positioned to ensure said first seal member seals between said cover and the appliance housing upon engagement of said first and second latching modules.

7. A package air conditioner comprising:

a housing including an access opening;

a unit for conditioning air disposed within said housing;

an electrical switch associated with said unit for conditioning air and located in said access opening;

a cover movably mounted to said housing and moveable between a first position and a second position, wherein said access opening is uncovered by said cover when said cover is arranged in said first position;

a first seal member attached to one of said housing and said cover; and said first seal member structured and arranged to be sealingly disposed between said cover and said housing when said cover is arranged in said second position to provide a moisture barrier around said access opening;

a base frame secured to said housing, wherein said base frame comprises a first latching module, and wherein said cover comprises a second latching module complementarily structured with said first latching module to allow latching together of said cover and said base frame when said cover is disposed in said second position, said first and second latching modules positioned to ensure said first seal member sealed between said cover and the appliance housing upon engagement of said first and second latching modules;

said first latching module comprising a projecting nub; and said second latching module comprising one of an aperture and a recess in a flange of said cover.

8. A package air conditioner comprising:

a housing including an access opening;

a unit for conditioning air disposed within said housing;

an electrical switch associated with said unit for conditioning air and located in said access opening;

a cover movably mounted to said housing and moveable between a first position and a second position, wherein said access opening is uncovered by said cover when said cover is arranged in said first position;

a first seal member attached to one of said housing and said cover; and said first seal member structured and arranged to be sealingly disposed between said cover and said housing when said cover is arranged in said second position to provide a moisture barrier around said access opening;

a base frame secured to said housing, wherein said base frame comprises a first latching module, and wherein said cover comprises a second latching module complementarily structured with said first latching module to allow latching together of said cover and said base frame when said cover is disposed in said second position, said first and second latching modules positioned to ensure said first seal member sealed between said cover and the appliance housing upon engagement of said first and second latching modules;

a bracket fixedly secured to said housing and to which said cover is pivotally connected;

a bracket sealing strip sandwiched between said bracket and said housing to form a first moisture barrier; and a frame sealing strip sandwiched between said base frame and said housing to form a second moisture barrier, wherein said frame sealing strip comprises a configuration complementary to said bracket sealing strip to together sealingly enclose an area on a face of said housing.

9. The package air conditioner of claim 1 wherein said cover comprises a slot at a bottom cover corner structured and arranged to facilitate drainage of moisture.

10. The package air conditioner of claim 2 wherein said cover comprises a top flange, wherein said bracket comprises a sealing flange, and further comprising an upper sealing member disposed adjacent said cover top flange, wherein said bracket sealing flange engages said upper sealing member to form a fluid tight seal between said bracket and said cover.

11. The package air conditioner of claim 1 wherein said first seal member is attached to said cover, said package air conditioner further comprising a sealing strip engageable with said first seal member, said sealing strip fixedly secured to said housing and extending circumferentially around said access opening.

12. The package air conditioner of claim 5 further comprising a filler plate insertable into at least one of said access openings.

13. A package air conditioner comprising:

a housing including an access opening;

a unit for conditioning air disposed within said housing;

an electrical switch associated with said unit for conditioning air located in said access opening and extending therefrom;

a cover;

means for movably mounting said cover to said housing, said cover movable between an unsealed position and a sealing position;

a seal member secured to a surface of said cover, said seal member including a cavity aligned with said unit access opening when said cover is disposed in said sealing position with said electrical switch extending into said cavity, whereby a fluid-tight seal is provided between said cover and said housing when said cover is disposed in said sealing position to prevent moisture external to said cover from reaching the access opening of the package unit.

14. The package air conditioner of claim 13, further comprising a sealing strip circumferentially extending around said access opening.

15. The package air conditioner of claim 14 wherein said seal member and said sealing strip each comprise a resilient foam construction.

16. The package air conditioner of claim 13 further comprising means for latching said cover in said sealing position.

17. A package air conditioner comprising:

a housing including an access opening;

a unit for conditioning air disposed within said housing;

an electrical switch associated with said unit for conditioning air located in said access opening and extending therefrom;

a bracket installed on said housing;

a cover pivotally connected to said bracket and moveable between first and second positions, wherein said cover uncovers a portion of said access opening when disposed in said first position; and a seal member associated with said cover, said seal member including a cavity, said electrical switch extending into said cavity when said cover is disposed in said second position, whereby a circumferential, water-tight seal is formed around said access opening.

18. The package air conditioner of claim 17 wherein said seal member is attached to said cover, said package air conditioner further comprising a sealing strip engageable with said seal member, said sealing strip fixedly secured to said housing and extending circumferentially around said access opening.

* * * * *